US007267589B2

(12) United States Patent
Norman

(10) Patent No.: US 7,267,589 B2
(45) **Date of Patent: *Sep. 11, 2007**

(54) SYSTEM AND APPARATUS FOR IMPROVING SAFETY AND THRUST FROM A HYDRO-DRIVE DEVICE

(75) Inventor: George I. Norman, Salt Lake City, UT (US)

(73) Assignee: Enviroprop Corporation, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/333,180

(22) Filed: Jan. 17, 2006

(65) Prior Publication Data

US 2006/0166570 A1 Jul. 27, 2006

Related U.S. Application Data

(63) Continuation-in-part of application No. 11/291,346, filed on Dec. 1, 2005, and a continuation-in-part of application No. 10/897,133, filed on Jul. 22, 2004.

(60) Provisional application No. 60/653,366, filed on Feb. 16, 2005, provisional application No. 60/646,470, filed on Jan. 24, 2005, provisional application No. 60/632,230, filed on Dec. 1, 2004.

(51) Int. Cl.
*B63H 1/16* (2006.01)

(52) U.S. Cl. ..... 440/67

(58) Field of Classification Search ..... 440/66, 440/67, 70, 71, 72, 76

See application file for complete search history.

(56) References Cited

U.S. PATENT DOCUMENTS

| | | | | |
|---|---|---|---|---|
| 116,513 | A | 6/1871 | Tripler | |
| 573,351 | A | 12/1896 | Parker | |
| 1,092,960 | A | 4/1914 | Taylor | |
| 1,620,129 | A | 3/1927 | Peterson | |
| 2,030,375 | A | 2/1936 | Kort | 115/42 |
| 2,091,677 | A | 8/1937 | Fredericks | 170/170 |
| 2,124,497 | A | 7/1938 | Slauson | 114/219 |
| 2,139,594 | A | 12/1938 | Kort | |
| 2,275,618 | A | 3/1942 | Edwards | 115/11 |
| 2,355,842 | A | 8/1944 | Arado | 115/40 |
| 2,444,217 | A | 6/1948 | Armentrout | 99/68 |
| 2,551,371 | A | 5/1951 | Grigg | |
| 3,112,610 | A | 12/1963 | Jerger | 60/35.5 |

(Continued)

FOREIGN PATENT DOCUMENTS

| | | |
|---|---|---|
| FR | 2658781 | 2/1990 |

*Primary Examiner*—Lars A. Olson
(74) *Attorney, Agent, or Firm*—Kunzler & McKenzie

(57) ABSTRACT

A system and apparatus are disclosed for improving safety and hydro-flow thrust from a hydro-drive device. The apparatus may include a shroud having a first opening for the ingress of water, and a second opening for the egress of water, and a vane extending inward from an interior surface of the shroud. The vane is configured to direct water to form a vortex that exits the shroud. The vane may include a fixed, planar region and a moveable, curved region attached to an interior surface of the shroud. Alternatively, the vane may be attached to a surface of a paddle configured to adjust the diameter of the second opening. The system may include a motor, a hydro-drive device coupled to the motor, the shroud, and the vane.

22 Claims, 13 Drawing Sheets

U.S. PATENT DOCUMENTS

| | | | | |
|---|---|---|---|---|
| 3,249,083 | A | 5/1966 | Irgens | 115/12 |
| 3,314,392 | A | 4/1967 | Molas et al. | 115/18 |
| 3,455,268 | A | 7/1969 | Gordon | 114/166 |
| 3,508,517 | A | 4/1970 | Hannan | 115/42 |
| 3,675,424 | A | 7/1972 | Oosterveld | 60/221 |
| 3,805,723 | A | 4/1974 | Bernaerts | 114/16 R |
| 3,889,624 | A | 6/1975 | Balius | 115/42 |
| 4,078,516 | A | 3/1978 | Balius | 115/42 |
| 4,106,425 | A | 8/1978 | Gruber | 115/42 |
| 4,304,558 | A | 12/1981 | Holtermann | 440/67 |
| 4,411,631 | A | 10/1983 | Makinen | 440/72 |
| 4,427,393 | A | 1/1984 | May | 440/67 |
| 4,565,533 | A | 1/1986 | Springer | 440/71 |
| 4,600,394 | A | 7/1986 | Dritz | 440/38 |
| 4,637,801 | A | 1/1987 | Schultz | 440/67 |
| 4,694,645 | A | 9/1987 | Flyborg et al. | 60/221 |
| 4,776,755 | A | 10/1988 | Bjorkestam et al. | 415/121 G |
| 4,826,461 | A | 5/1989 | Newman | 440/71 |
| 4,832,634 | A | 5/1989 | Kearns | 440/67 |
| 4,957,459 | A | 9/1990 | Snyder | 440/72 |
| 5,009,620 | A | 4/1991 | Feranda, Sr. | 440/72 |
| 5,078,516 | A | 1/1992 | Kapon et al. | 385/129 |
| 5,145,428 | A | 9/1992 | Harrison | 440/89 |
| 5,292,088 | A | 3/1994 | Lemont | 244/65 |
| 5,389,021 | A | 2/1995 | Padgett | 440/67 |
| 5,651,707 | A | 7/1997 | Lemont | 440/67 |
| 5,846,103 | A | 12/1998 | Varney et al. | 440/38 |
| 5,848,922 | A | 12/1998 | Itima et al. | 440/66 |
| 5,964,626 | A | 10/1999 | Varney et al. | 440/38 |
| 6,059,618 | A | 5/2000 | Purnett et al. | 440/38 |
| 6,190,218 | B1 * | 2/2001 | Hall et al. | 440/67 |
| 6,475,045 | B2 | 11/2002 | Schultz et al. | 440/71 |
| 6,846,210 | B1 | 1/2005 | Abella | 440/67 |
| 6,986,689 | B2 * | 1/2006 | Norman | 440/67 |
| 2003/0104733 | A1 | 6/2003 | Ishigaki et al. | 440/71 |

* cited by examiner

SYSTEM AND APPARATUS FOR IMPROVING SAFETY AND THRUST FROM A HYDRO-DRIVE DEVICE

CROSS-REFERENCES To RELATED APPLICATIONS

This application is a continuation in part of and claims benefit of U.S. patent application Ser. No. 10/897,133 entitled "SYSTEM AND APPARATUS FOR IMPROVING SAFETY AND THRUST FROM A HYDRO-DRIVE DEVICE," filed on Jul. 22, 2004 for George I. Norman, U.S. patent application Ser. No. 11/291,346 entitled "SYSTEM AND APPARATUS FOR IMPROVING SAFETY AND THRUST FROM A HYDRO-DRIVE DEVICE," filed on Dec. 1, 2005 for George I. Norman, U.S. Provisional Patent Application No. 60/632,230 entitled "Enviroprop Suproguard" filed on Dec. 1, 2004 for George I. Norman, U.S. Provisional Patent Application No. 60/646,470 entitled "Enviroprop Hydro Vortex Diverters" filed on Jan. 24, 2005 for George I. Norman, and U.S. Provisional Patent Application No. 60/653,366 entitled "Enviroprop Hydro Vortex Diverters No. 2" filed on Feb. 16, 2005 for George I. Norman, each of which are incorporated herein by reference.

BACKGROUND OF THE INVENTION

1. Field of the Invention

This invention relates to marine propulsion devices such as outboard motors, stern drive units and the like, and more particularly relates to improving safety and hydro-flow thrust from hydro-drive devices.

2. Description of the Related Art

For over 100 years screwdriven propellers and impellers have been used to propel marine vehicles. Over the years, the technology of the propulsion drives has changed incredibly. However, the technology of the propeller/impeller, aside from sizes and shapes, has remained relatively unchanged.

As a propeller/impeller turns, water is drawn in and is accelerated through the fly wheel action of a propeller/impeller increasing the higher-velocity stream of water behind (aft) the propeller/impeller. Accelerating the water by the action of pulling water in and pushing water out at a higher velocity is commonly known as adding momentum to the water. This change in momentum or acceleration of the water (hydro-flow) results in a force called "thrust." A curvature of the propeller/impeller blade creates low-pressure on the back of the blade, thus inducing lift, much like the wing on an airplane. With a marine propeller/impeller, the lift is translated into horizontal movement.

The spinning blades of the propeller/impeller produce hydro-flow thrust, which can depend upon many factors. Examples of such factors include volume of water accelerated per time unit, propeller/impeller diameter, velocity of incoming hydro-flow, density of water, and the SHP (shaft horsepower) accelerating the propeller/impeller. As in any motorized industry, great expense and effort is put into the improvement of efficiency and power of the motor. Perhaps the largest factor relating to efficiency and power or hydro-flow thrust is the propeller/impeller.

The propeller shroud also has the additional benefit of protecting submerged objects from contact with the propeller/impeller. With ever increasing marine vehicle ownership, incidents of injury or damage due to propeller/impellers strikes, though unfortunate, seem commonplace. The shroud prevents swimmers, water skiers, water sports enthusiast, sea and marine life from encountering or being entangled by the spinning blades of a propeller/impeller. Safety is accomplished by enclosing the entire fly wheel area of the propeller/impeller within the propeller shroud.

Shrouds are available that may perform the function of protecting people, marine sea and plant life from the propeller/impeller. However, available shrouds tend to restrict water flow, increase drag, or modify the exiting water stream. Each of the aforementioned actions appreciably reduces hydro-flow thrust, thus negatively affecting the performance.

From the foregoing discussion, it should be apparent that a need exists for a system and apparatus that protects people, marine sea and plant life, and increases hydro-flow thrust generated from a boat propeller/impeller. Beneficially, such a system and apparatus would increase hydro-flow, decrease drag, would improve performance by increasing the volume and velocity of hydro-flow thrust in a vortex exiting the shroud

SUMMARY OF THE INVENTION

The present invention has been developed in response to the present state of the art, and in particular, in response to the problems and needs in the art that have not yet been fully solved by currently available hydro-drive device thrust enhancement systems. Accordingly, the present invention has been developed to provide a system and apparatus for improving thrust from a hydro-drive device that overcome many or all of the above-discussed shortcomings in the art.

The apparatus to improve thrust may include a shroud having a first opening for the ingress of water, and a second opening for the egress of water, and a vane extending inward from an interior surface of the shroud. The vane is configured to direct water to form a vortex that exits the shroud. In a further embodiment, the vane comprises a planar region directly attached to an interior surface of the shroud and a curved region configured to change curvature in response to increasing or decreasing thrust from the hydro-drive device.

The vane may be formed of a material having a tension configured to allow the curvature of the vane to change in response to the thrust of the hydro-drive device and configured to return to an original configuration. In one embodiment, the apparatus may include a spring tension bar having a first end coupled to the interior surface and a second end removably coupled to a paddle. The paddle is configured to adjust the diameter of the second opening in response to thrust from the hydro-drive device, and may have the vane directly connected to a surface of the paddle.

In a further embodiment, the apparatus is configured having a plurality of vanes extending toward the interior of the shroud, each vane configured to direct water to form a vortex that exits the shroud. The shroud may include a mounting plate coupled to an outside surface of the shroud. The mounting plate is configured to couple the shroud to a vehicle. The shroud may be configured to at least partially enclose the hydro-drive device.

A system for improving thrust is also provided. The system may include a motor, a hydro-drive device coupled to the motor, a shroud having a first opening configured to intake water, and a second opening configured to exhaust water, and a vane extending inward from an interior surface of the shroud. The vane is configured to direct water to form a vortex that exits the shroud.

In an alternative embodiment, the apparatus may include a shroud having a first opening for the ingress of water, and a second opening for the egress of water and a vane extending inward from an interior surface of the shroud. The vane is configured to direct water to form a vortex that exits the shroud, and comprises a planar region directly attached to an interior surface of the shroud and a curved region configured to change curvature in response to increasing or decreasing thrust from the hydro-drive device.

Alternatively, the apparatus may comprise a shroud having a first opening for the ingress of water, and a second opening for the egress of water, and a vane extending inward from an interior surface of the shroud. The vane is configured to direct water to form a vortex that exits the shroud. A spring tension bar is also provided and has a first end coupled to the interior surface and a second end removably coupled to a paddle. The paddle may be configured to adjust the diameter of the second opening in response to thrust from the hydro-drive device.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are given to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
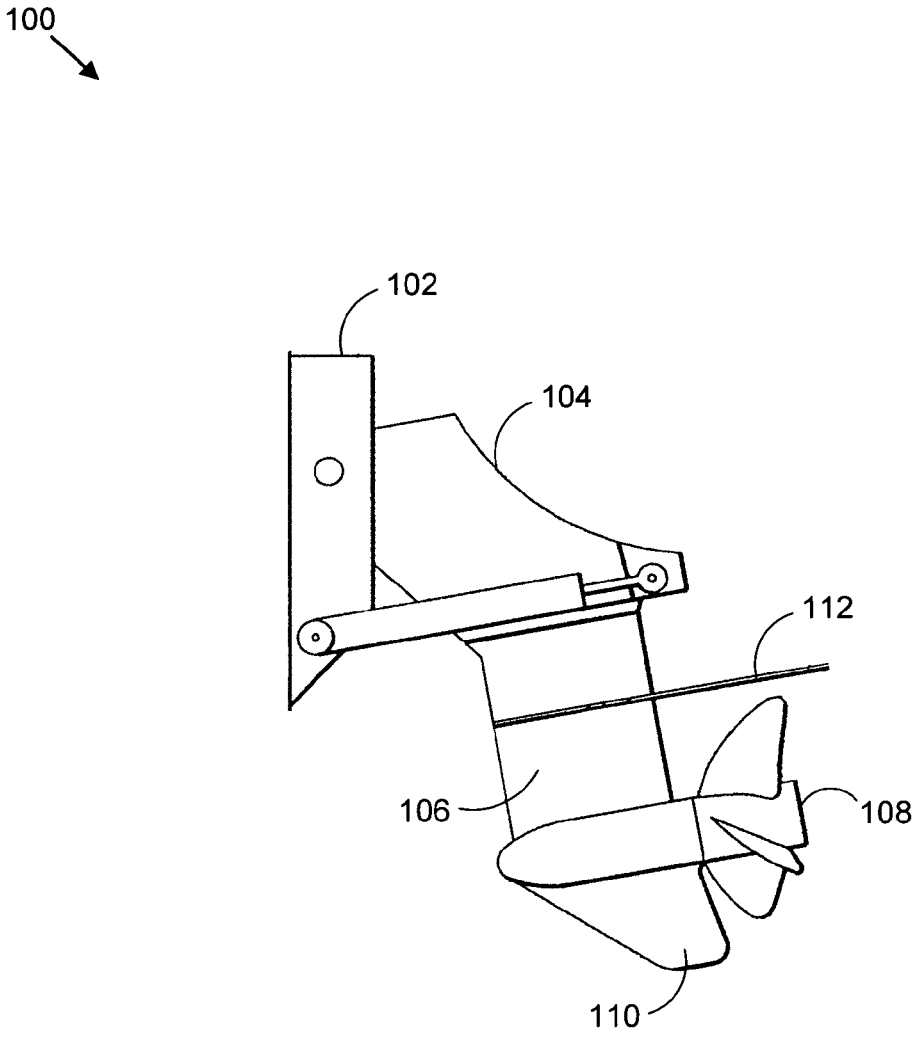
FIG. 1 (Prior Art)
FIG. 1 is a schematic block diagram illustrating one embodiment of a system for moving a marine vehicle in accordance with the prior art.

FIG. 1 is a side view of one embodiment of a system 100 for moving a marine vehicle in accordance with the prior art. The system 100 may include a transom mount assembly 102 for connecting the system 100 to a stern or transom of a boat (not shown). The transom mount assembly 102 is configured to transfer power from a motor to an upper gear case assembly 104. The upper gear case assembly 104 directs the power through a drive shaft (not shown) to the lower unit 106 and in turn to a hydro-drive device 108. The system 100 may also include a skeg 110 and a cavitation plate 112 (also referred to as "anticavitation plate" or "antiventillation plate"). The cavitation plate 112 prevents surface air from reaching the hydro-drive device 108.

Figure 2:
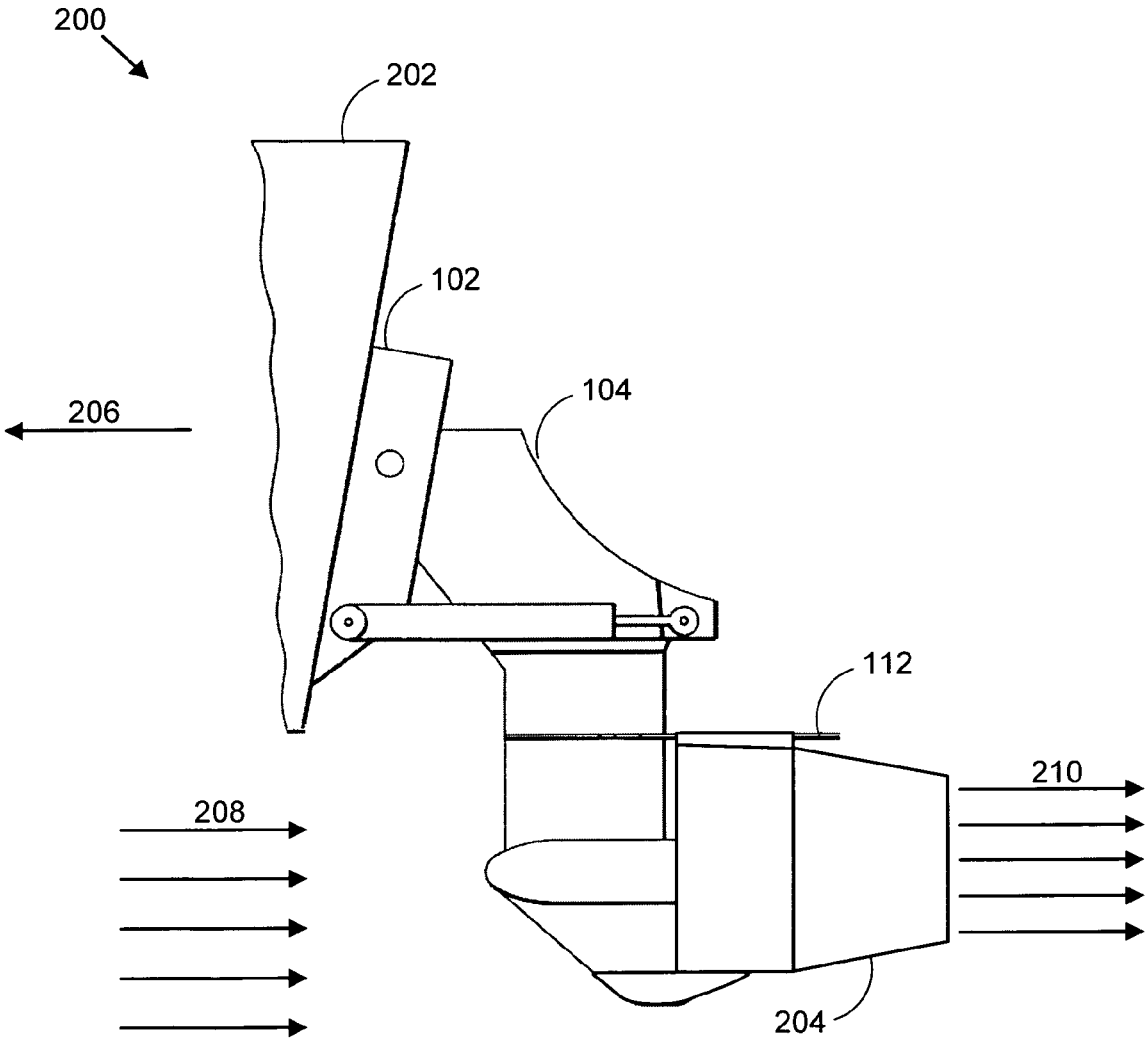
FIG. 2 is a schematic block diagram illustrating one embodiment of a system for moving a marine vehicle in accordance with the present invention.

FIG. 2 is a schematic block diagram graphically illustrating one embodiment of a system 200 for moving a marine vehicle in accordance with the present invention. The system 200 may include the stern of the boat 202 connected to the transom mount assembly 102 as described above with reference to FIG. 1. Additionally, the system 200 may comprise a shroud 204 configured to at least partially enclose the hydro-drive device. In one embodiment, the shroud 204 is coupled to the cavitation plate 112 and the skeg 110.

The depicted embodiment illustrates the shroud 204 coupled to a stern-drive system. Alternatively, the shroud 204 may be similarly coupled to outboard motor assemblies, inboard motor assemblies, jet propelled vehicles such as personal water craft, and other marine drive assemblies having hydro-drive devices 108. As used herein, the term "hydro-drive device" means any marine vehicle thrust inducing device such as, but not limited to, propellers, impellers, and the like.

The system 200 is configured to enable the boat 202 to move about in water. The boat 202 may move in both a forward direction represented by arrow 206 and a reverse direction. The gear case assembly 104 is mounted for pivotal movement about a horizontal axis to enable the boat to turn. As the boat 202 moves through water, water enters the shroud 204 in a direction illustrated by arrows 208 and exits in a direction indicated by arrows 210. The shroud 204 may comprise a first opening 302 (shown in FIG. 3) configured to allow the unrestricted ingress of water, and a second opening 304 (shown in FIG. 3) for the egress of water.

Figure 3:
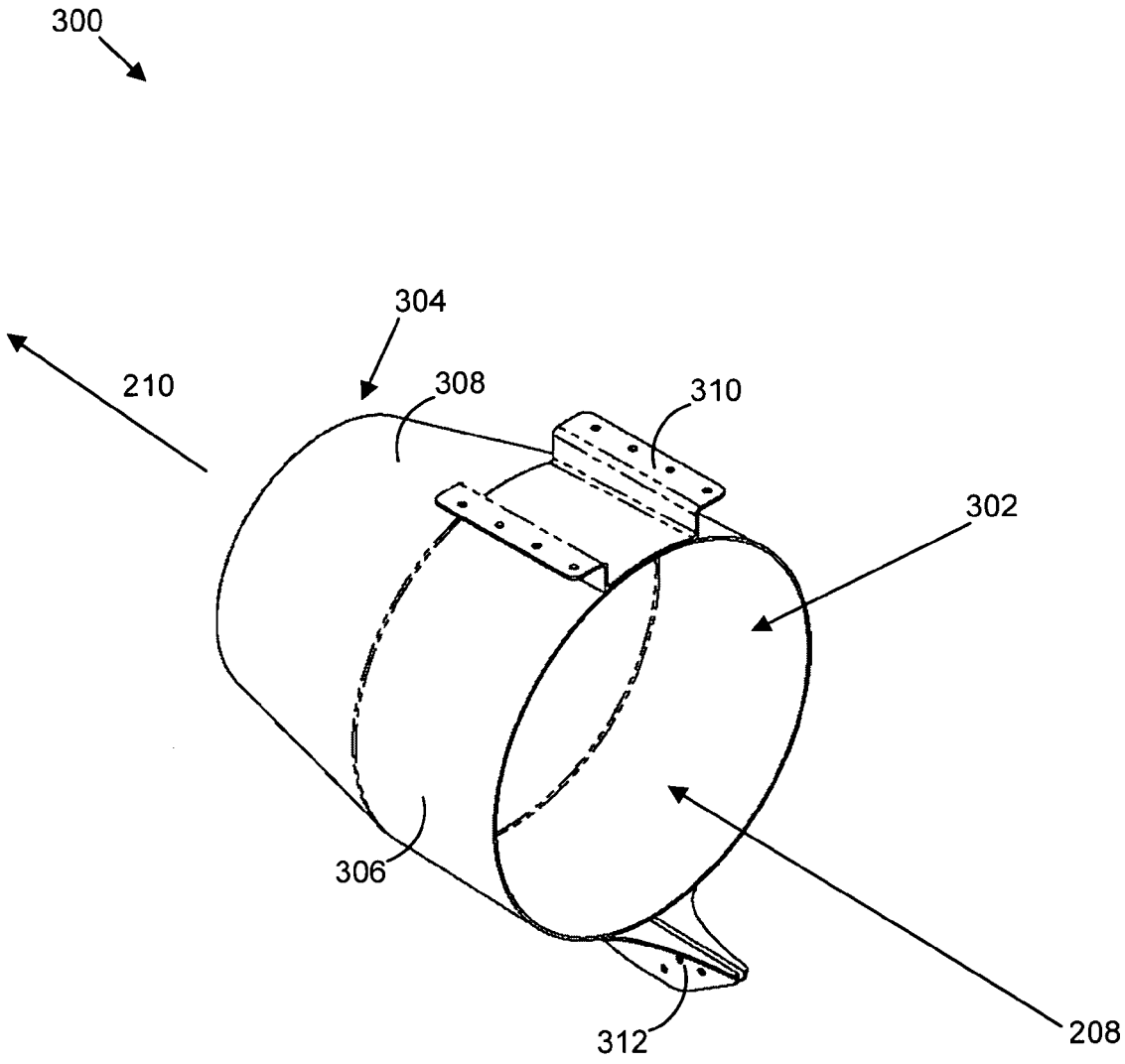
FIG. 3 is a perspective view illustrating one embodiment of a shroud in accordance with the present invention.

FIG. 3 is a perspective view shown from the top and to one side and illustrating one embodiment of the shroud 204 in accordance with the present invention. The shroud 204 may comprise a substantially tubular cylinder having the first opening 302 and the second opening 304. The shroud 204 is configured to at least partially circumferentially enclose the hydro-drive device 108 in a cylindrical region 306. The first opening 302 may have a diameter slightly larger than the hydro-drive device 108 in order to circumferentially enclose the hydro-drive device. The cylindrical region 306 may alternatively completely circumferentially enclose the hydro-drive device 108 thereby protecting swimmers, water skiers, water sports enthusiast, and sea and marine life from encountering or being entangled by the hydro-drive device 108.

In a further embodiment, the shroud 204 may comprise a conical region 308. As is well known to those skilled in the art, the cylindrical region 306 together with the conical region 308 form what is known as a "Kort Nozzle." The conical region 308 causes water flow to accelerate in order to exit through the second opening 304 with a Venturi-like effect.

The shroud 204 may also include a mounting plate 310 for connecting the shroud 204 to the cavitation plate 112, and a skeg coupler 312 for securing the shroud 204 to the skeg 110. Fastening devices (not shown) may include standard nuts and bolts. Alternatively, a keyed fastening device may be used when connecting the skeg coupler 312 to the skeg 110 in order to prevent theft of the shroud 204 and the hydro-drive device 108.

The shroud 204 may be formed of a light-weight metallic based material such as, but not limited to, aluminum alloys, steel alloys, titanium alloys, or the like. Additionally, the shroud 204 may be formed of composite materials including carbon fiber, high-impact plastics, or fiberglass. Depending upon the material used, the shroud may be pressed, rolled, injection molded, thermoformed, layed-up, spun, or extruded. Different finishes may also be applied to a surface of the shroud 204 in order to reduce drag and form a protective layer.

Figure 4B:
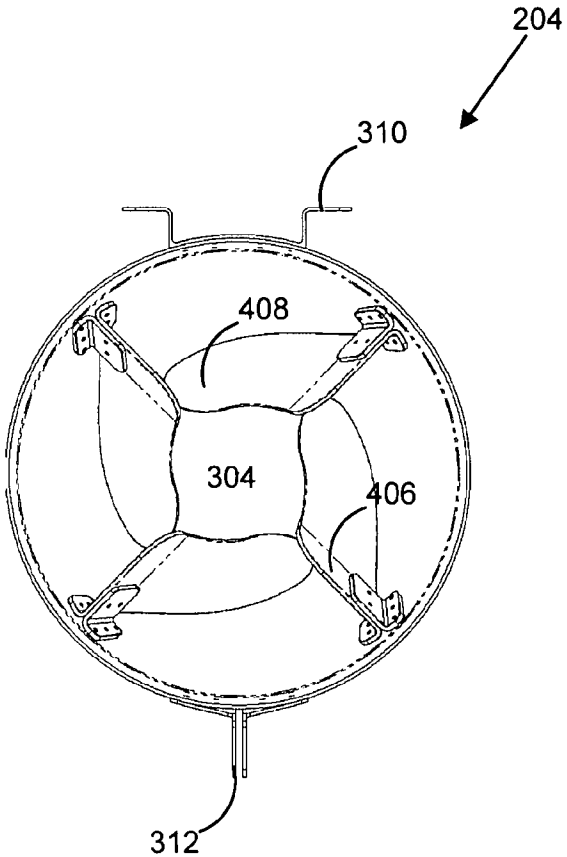
FIG. 4*b* is a front view of the shroud of FIG. 4*a;*
Figure 4A:
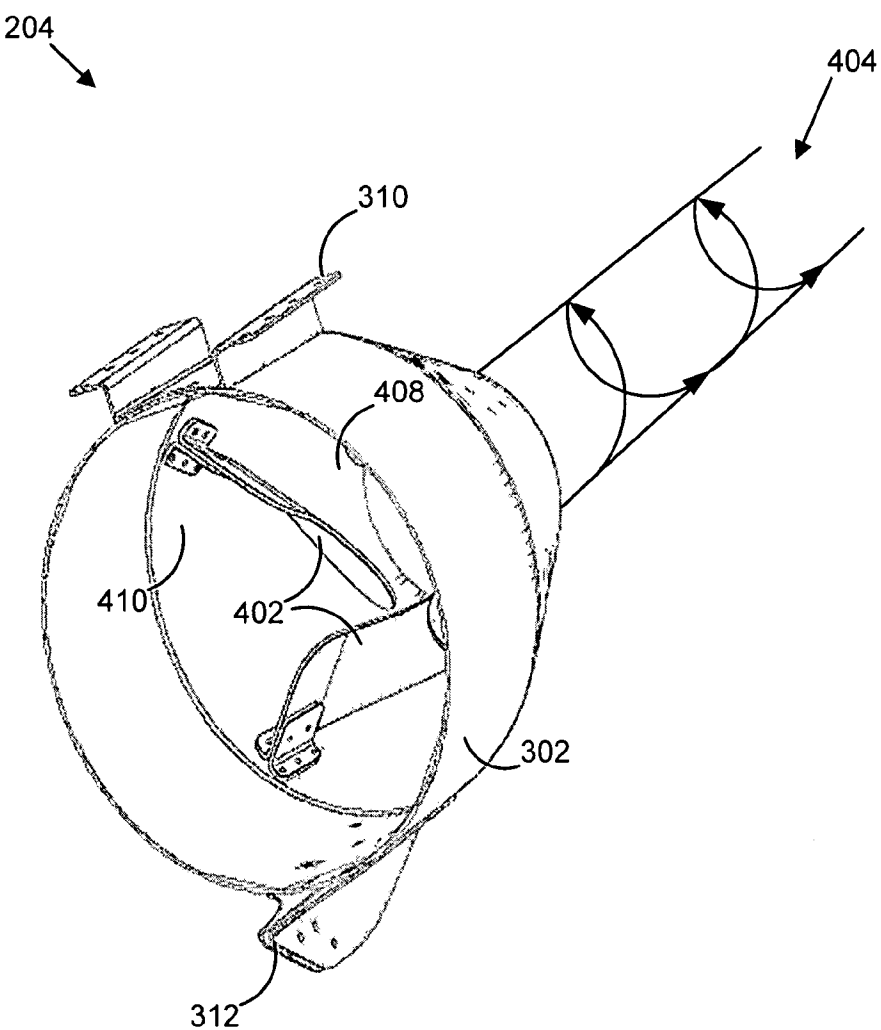
FIG. 4*a* is a perspective view illustrating one embodiment of a shroud in accordance with the present invention.

FIGS. 4*a* and 4*b* graphically illustrate one embodiment of the shroud 204 having a plurality of vanes 402 for directing fluid to form a vortex 404 as the water exits the shroud. Alternatively, the shroud 204 may comprise a single vane 402 for directing fluid to form a vortex 404. As used herein, the term "vortex" means fluid flow involving rotation about an axis.

In one embodiment, each vane 402 may include a planar region 406 and a curved region 408. Alternatively, the vane 402 may be configured having only the planar region 406 or only the curved region 408. In an alternative embodiment, the vane 402 may be configured having a curvature at the end nearest the second opening 304, also referred to as the "distal end." Each vane 402 may extend inward from an interior surface of the shroud 204, and extend longitudinally towards the second opening 304. Additionally, the vanes 402 are preferably angled in such a way as to induce and/or enhance the vortex 404 formed by the hydro-drive device 108. In a further embodiment, the planar region 406 of each vane is removably coupled to the interior surface 410 of the shroud. In an alternative embodiment, the vanes 402 may be configured as grooves or channels (not shown) formed in the interior surface 410 of the shroud 204 and angled to direct water to enhance the vortex 404.

The curved region 408 may be free to change curvature in response to thrust produced by the hydro-drive device 108. Alternatively, the entirety of each vane 402 may be fixedly coupled to the shroud 204. For example, the vane 402 may be riveted, welded, bolted, attached using adhesive, or the like. As thrust increases, the vanes 402 may be configured to adjust the curvature of the curved region 408. In one embodiment, each vane 402 is formed of a material selected to have a spring tension configured to adjust the curvature of the curved region 408 in response to the thrust or water pressure, and subsequently return to an original curved configuration. For example, as thrust increases, each vane 408 may "straighten" and effectively increase the diameter of the second opening 304.

Figure 5A:
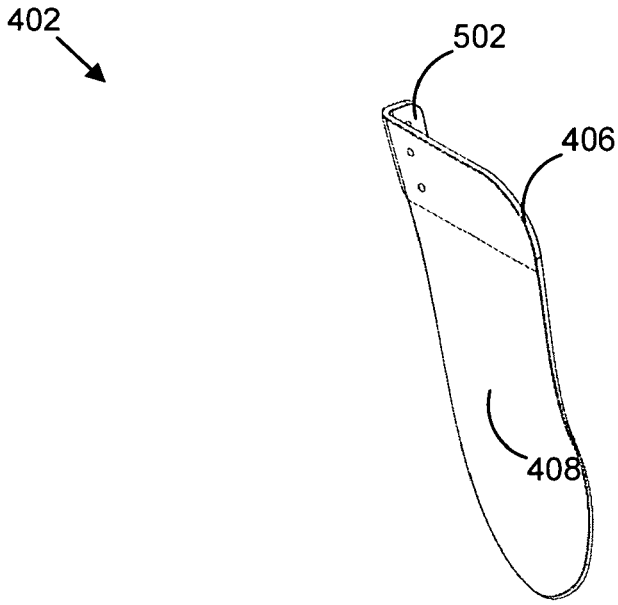
FIG. 5*a* is a perspective view illustrating one embodiment of a vane in accordance with the present invention.
Figure 5B:
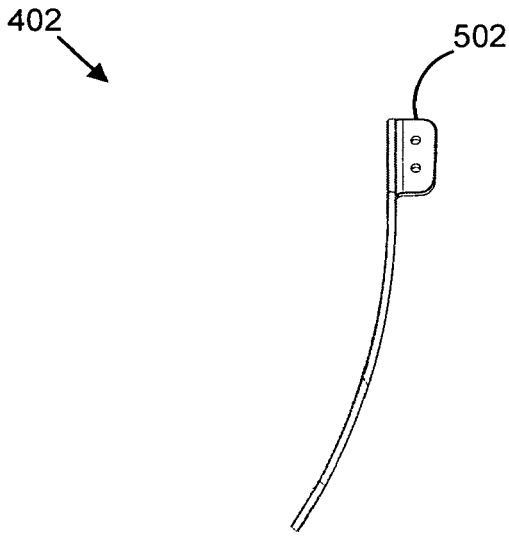
FIG. 5*b* is a side view of the vane of FIG. 5*a;*

FIG. 5*a* is a perspective view of one embodiment of the vane 402 in accordance with the present invention. FIG. 5*b* is a side view of the vane 402 of FIG. 5*a*. The vane 402 may be used in the shrouds of FIGS. 2-4*b*. The vane 402 may include an angle bracket 502 for connecting to the shroud 204. Alternatively, the angle bracket 502 may be a separate unit or formed into the surface of the shroud 204. In one embodiment, the vane 402 is formed of a metal such as aluminum. In a further embodiment, the vane 402 may be formed of a ceramic material, composite material, or a high-impact rigid plastic.

In one embodiment, the vane 402 is configured with a curve to direct water to form a vortex as described above with reference to FIGS. 4*a* and 4*b*. The vane 402 may be angled to form counter-clockwise or clockwise vortices depending upon the direction of spin of the hydro-drive device 108.

Figure 6:
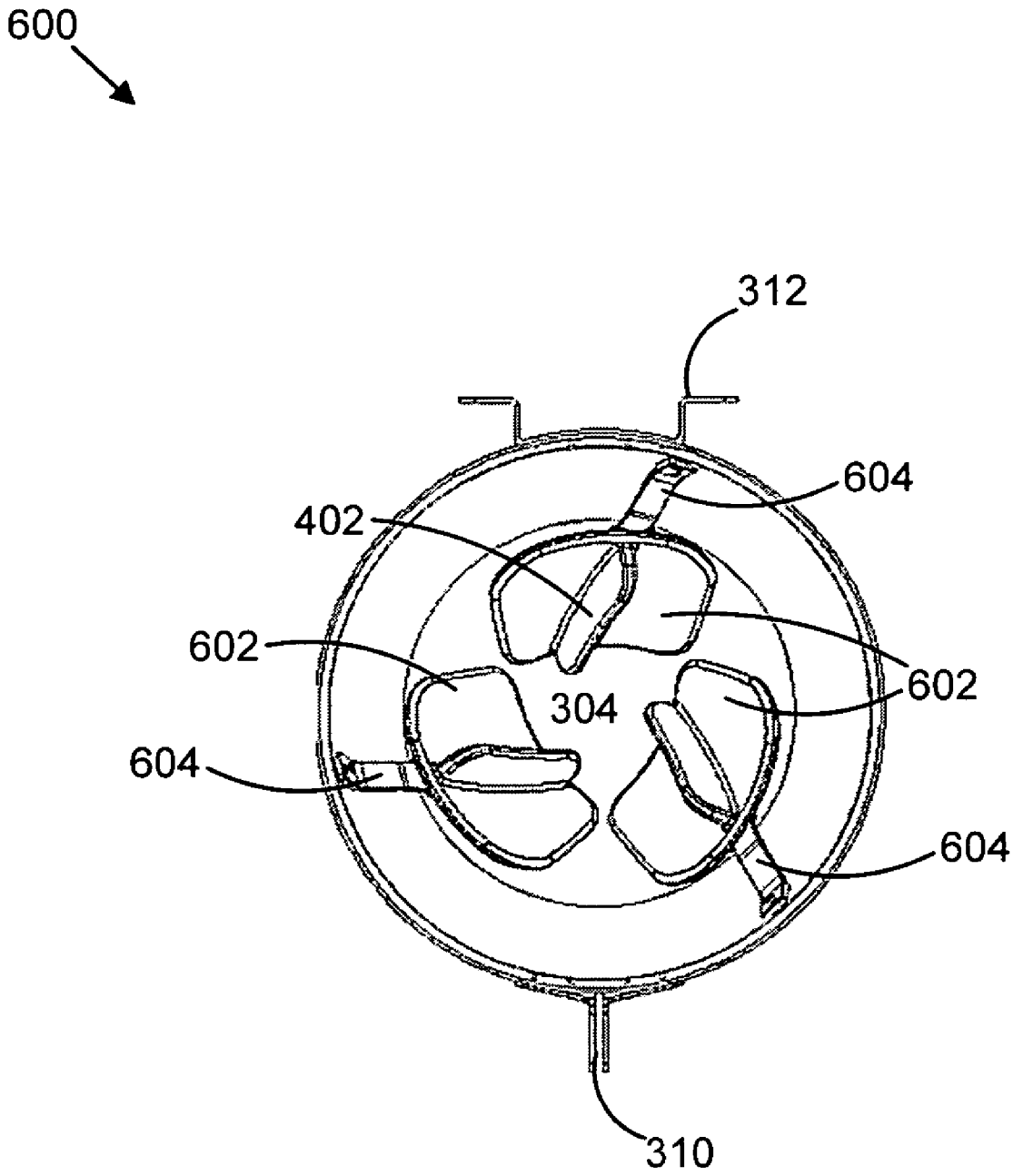
FIG. 6 is a front view of one embodiment of a shroud in accordance with the present invention.

FIG. 6 is a front view of one embodiment of the shroud 204 in accordance with the present invention. In the depicted embodiment, the shroud 204 comprises a plurality of paddles 602. Each paddle 602 may be coupled to a spring tension bar 604. The spring tension bar will be described in greater detail below with reference to FIG. 7*c*. Each paddle 602 may be configured with the vane 402. As thrust from the hydro-drive device 108 increases, the pressure on the paddles 602 causes the spring tension bar 604 to partially collapse, thereby increasing the diameter of the second hole 304. However, even as the diameter of the second hole 304 increases, the vanes 402 continue to direct water to form the vortex 404 as water exits the shroud 204.

Figure 7A:
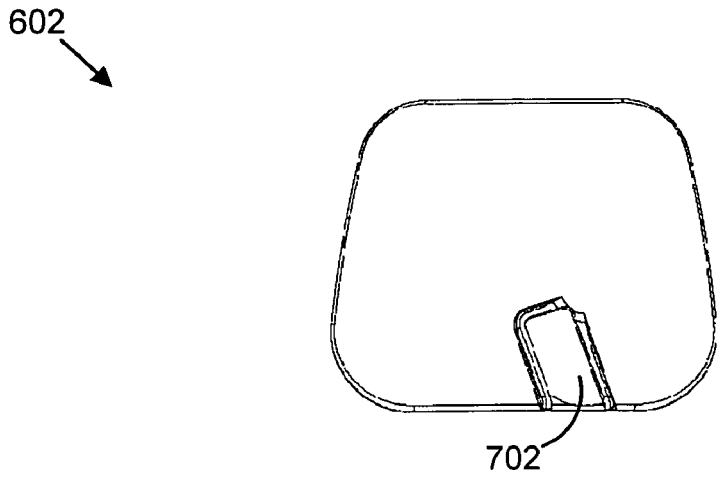
FIG. 7*a* is side view of one embodiment of a paddle in accordance with the present invention.
Figure 7B:
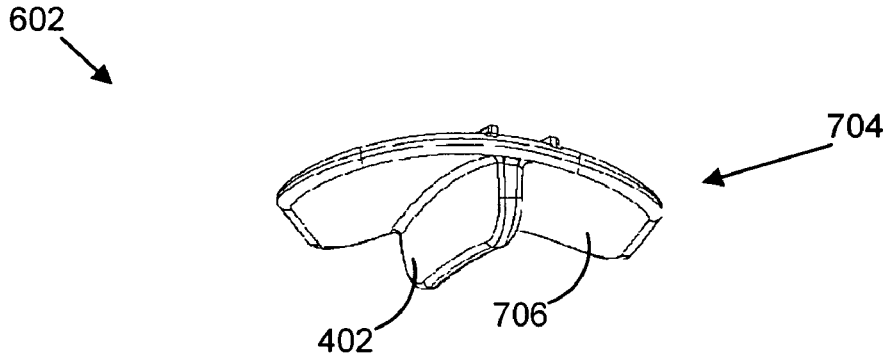
FIG. 7*b* is a perspective view of the paddle of FIG. 7*a;*

Referring jointly to FIGS. 7*a* and 7*b*, shown therein are perspective views taken from the top and front respectively, and graphically illustrating the paddle 602 in accordance with the present invention. In one embodiment, the paddle 602 has a substantially rectangular shape having a slot 702 for removably coupling to one end of the spring tension bar 604. The paddle 602 may be coupled to the spring tension bar 604 using a fastening device (not shown) such as a bolt, a rivet, or the like.

In one embodiment, the paddle 602 has a curved profile 704 with the vane 402 extending from an inward facing surface 706. The vane 402 may be coupled to the paddle as described above, or alternatively, the vane 402 may be formed as an integral part of the paddle. In a further embodiment, the curved profile 704 may be asymmetric such that the paddle 602 may direct water to form the vortex 404. Additionally, the paddle 602 may be injection molded integral with the vane 402.

Figure 7C:
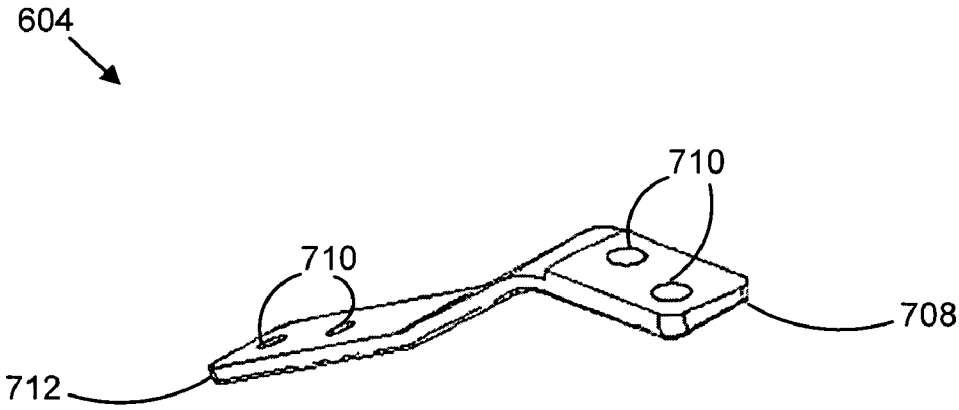
FIG. 7*c* is a perspective view of one embodiment of a spring tension bar in accordance with the present invention.

FIG. 7*c* is a perspective view taken from the top and side and illustrates one embodiment of the spring tension bar 604 in accordance with the present invention. In the depicted embodiment, the spring tension bar 604 comprises a first end 708 configured to couple to the interior surface 410 of the shroud 204. The spring tension bar 604 may also comprise a plurality of holes 710 for receiving fastening devices. In a further embodiment, the spring tension bar 604 includes a second end 712 for removably coupling the paddle 702.

The spring tension bar 604 may be formed of a metallic based material such as an aluminum alloy, or other light weight metallic based material. Alternatively, the spring tension bar 604 may be formed of any material configured to return to an original configuration after the thrust from the hydro-drive device 108 has been removed.

Figure 8A:
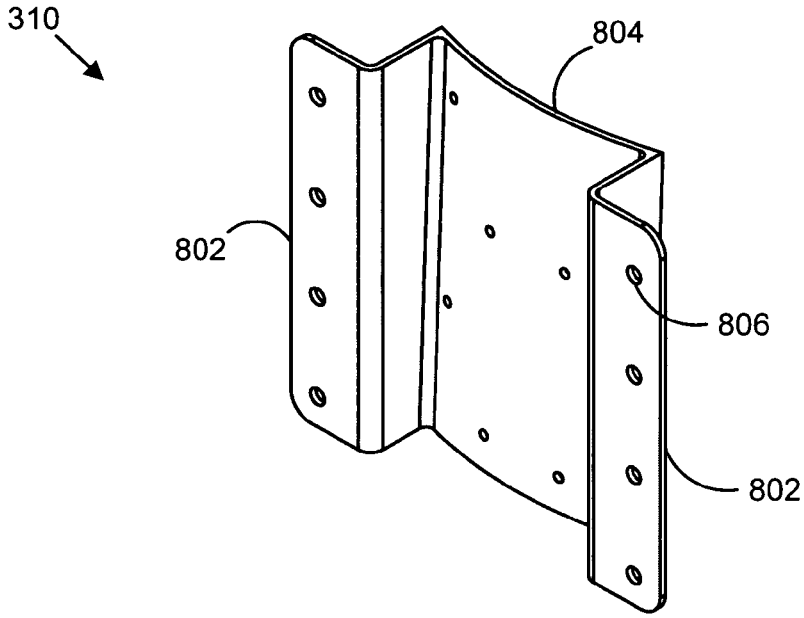
FIG. 8*a* is a perspective view of one embodiment of a mounting plate in accordance with the present invention.

FIG. 8*a* is a perspective view taken from the side and top and graphically illustrates one embodiment of the mounting plate 310 in accordance with the present invention. In one embodiment, the mounting plate 310 is configured to mount to the cavitation plate 112 of an outboard or stern drive motor housing. The mounting plate 310 may comprise a plurality of raised side portions 802 for engaging the cavitation plate 112 and a curved central region 804 for engaging the shroud 204. In a further embodiment, the mounting plate 310 may engage any flat surface such as a boat bottom, thereby enabling the shroud 204 to be mounted to marine vehicles that do not employ outboard motor housings such as, but not limited to tugboats, cruise ships, ocean cargo ships, and personal water craft. In an alternative embodiment, the mounting plate 310 also includes a plurality of holes 806 for receiving fastening devices.

Figure 8B:
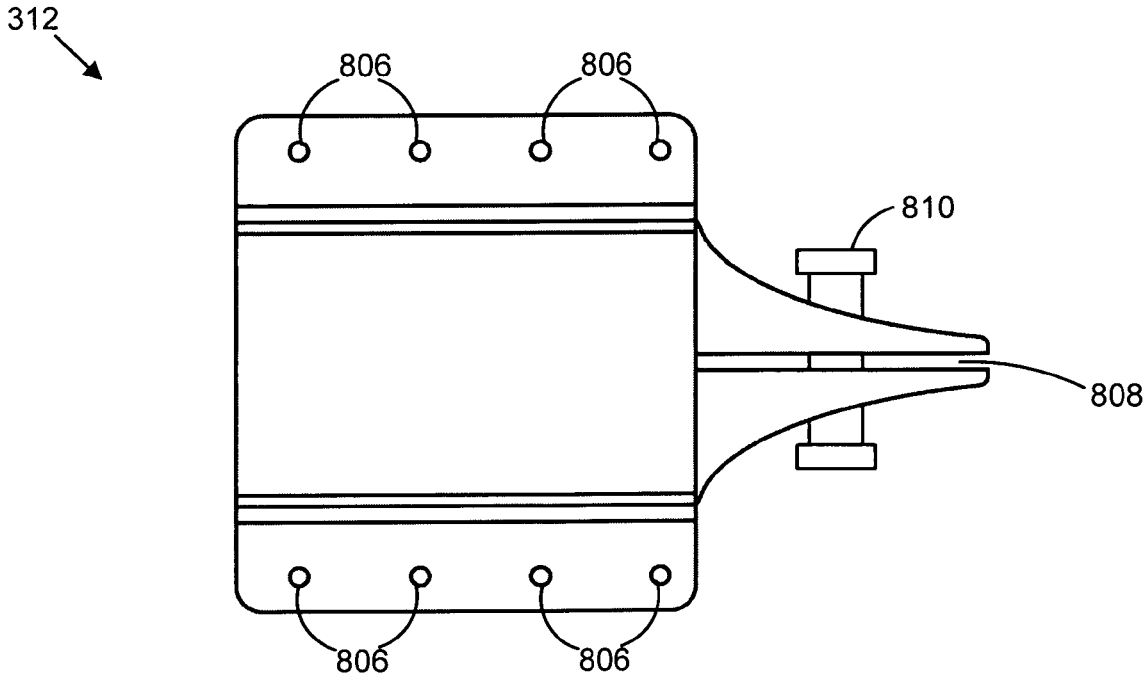
FIG. 8*b* is a bottom view of one embodiment of a skeg coupler in accordance with the present invention.

FIG. 8*b* is a top view of the skeg coupler 312 of FIG. 3 in accordance with the present invention. In one embodiment, the skeg coupler 312 comprises a slot 808 for receiving the skeg 110 of the outboard system 100. Alternatively, the slot 808 may receive the skeg of non-outboard marine drive systems. Once the skeg coupler 312 has been attached to the skeg 110, a unique fastener, such as a bolt 810 with a unique key may be locked in place in order to prevent theft of the hydro-drive device 108 or the shroud 204.

Figure 9A:
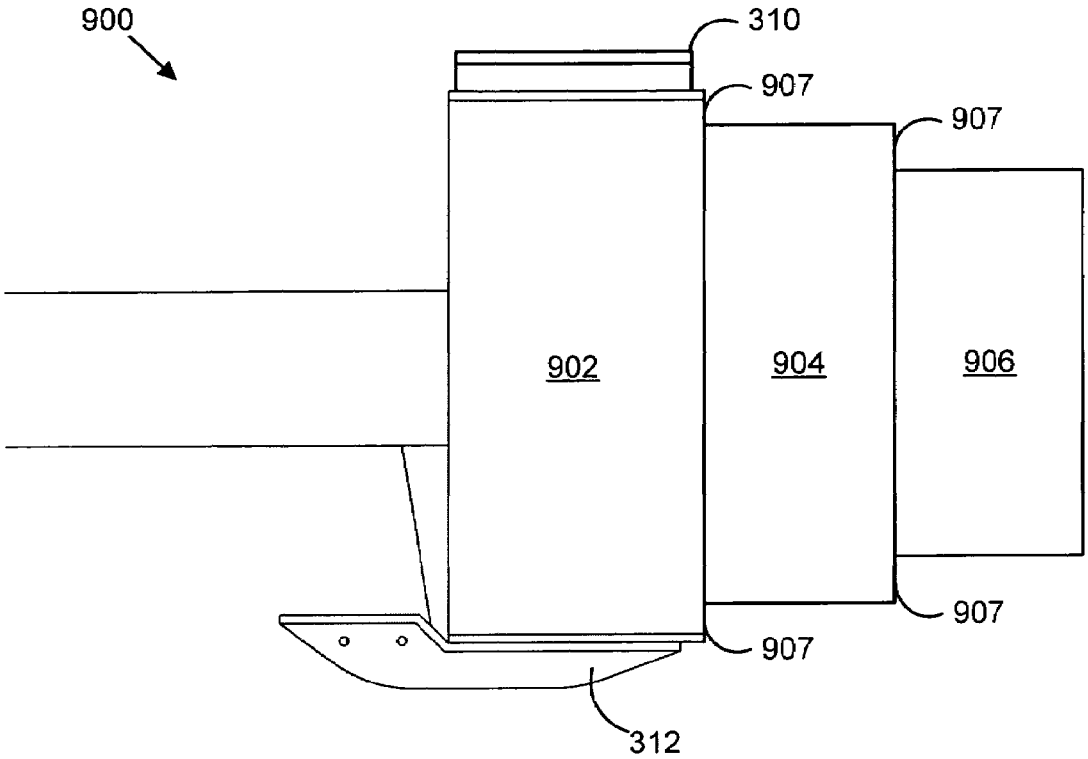
FIG. 9*a* is a schematic side view of one embodiment of a telescoping shroud in accordance with the present invention.

FIG. 9*a* is a side view of a telescoping shroud 900 in accordance with the present invention. In one embodiment, the telescoping shroud 900 comprises the mounting plate 310 and the skeg coupler 312. The telescoping shroud 900 may also include a plurality of cylinders 902, 904, 906, each of a different diameter. In a further embodiment, a first cylinder 902 may be coupled to the mounting plate 310 and the skeg coupler 312. A second cylinder 904 may be fixedly coupled to the first cylinder 902. The second cylinder 904, may alternatively be slidably coupled to the first cylinder 902 and configured to extend with increasing pressure or thrust produced by the hydro-drive device 108. Likewise, a third cylinder 906 may be fixedly or slidably coupled. Openings 907 between the cylinders 902, 904, 906 may allow the egress of fluid from the shroud 902.

Figure 9B:
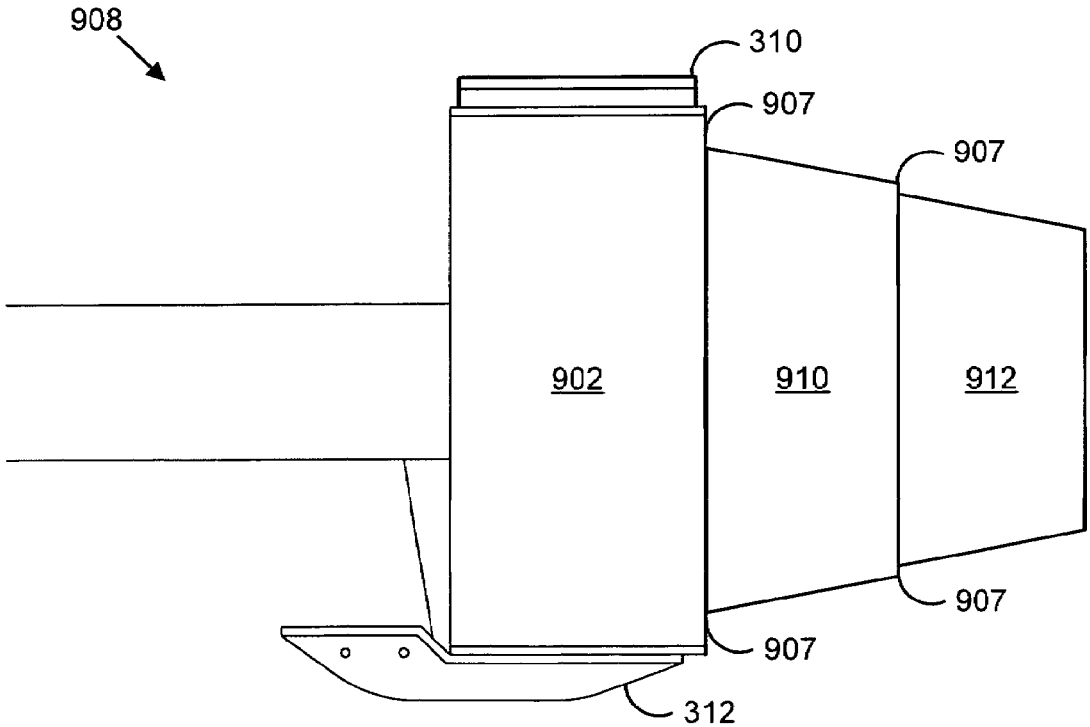
FIG. 9*b* is a side view of a further embodiment of a telescoping shroud in accordance with the present invention.

FIG. 9*b* is a side view of a further embodiment of a telescoping shroud 908 in accordance with the present invention. In the embodiment of FIG. 9*b*, the shroud 908 comprises the mounting plate 310, the skeg coupler 312, and the first cylinder 902. In a further embodiment, a substantially conical cylinder 910 may be coupled to the first cylinder 902 as described above. A second conical cylinder 912 may similarly be coupled to first conical cylinder 910. Alternatively, the telescoping shroud 908 may comprise the first cylinder 902 and the first conical cylinder 910. As described above, the cylinders 902, 910, 912 may be either fixedly coupled or slidably coupled and have openings 907 for the egress of water.

Figure 10A:
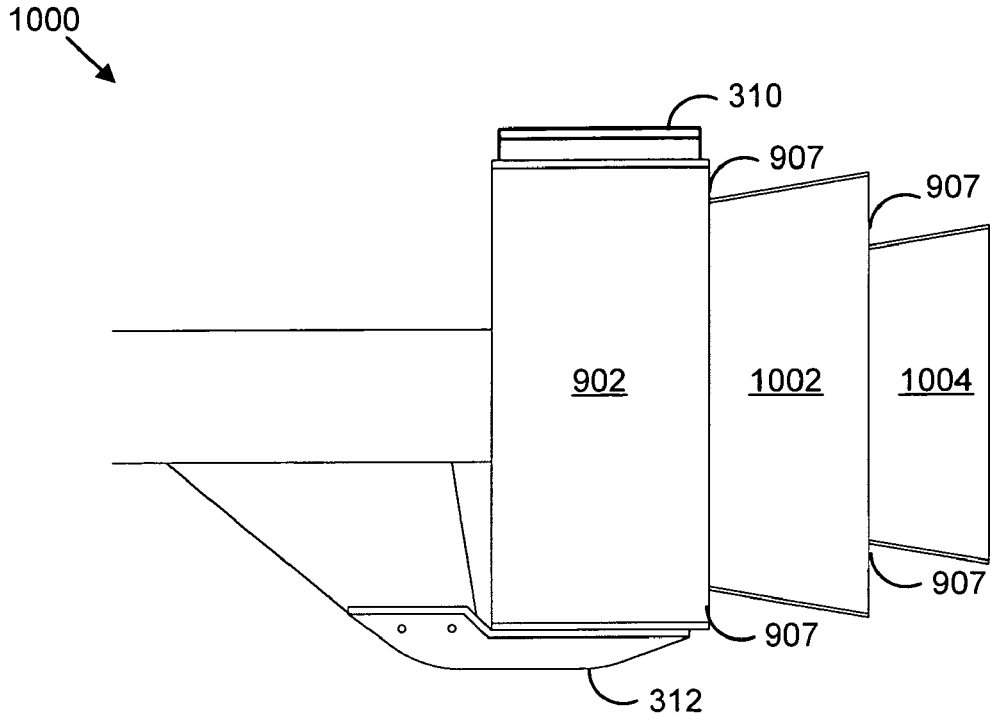
FIG. 10*a* is a side view of another embodiment of a telescoping shroud in accordance with the present invention.

FIG. 10*a* is a side view of another embodiment of a telescoping shroud 1000 having diverging conical sections in accordance with the present invention. In one embodiment, the telescoping shroud 1000 includes the mounting plate 310, the skeg coupler 312, and first and second diverging cylinders 1002, 1004. The diverging cylinders 1002, 1004 when coupled to the first cylinder 902 may form openings 907 as described above for the egress of water.

Figure 10B:
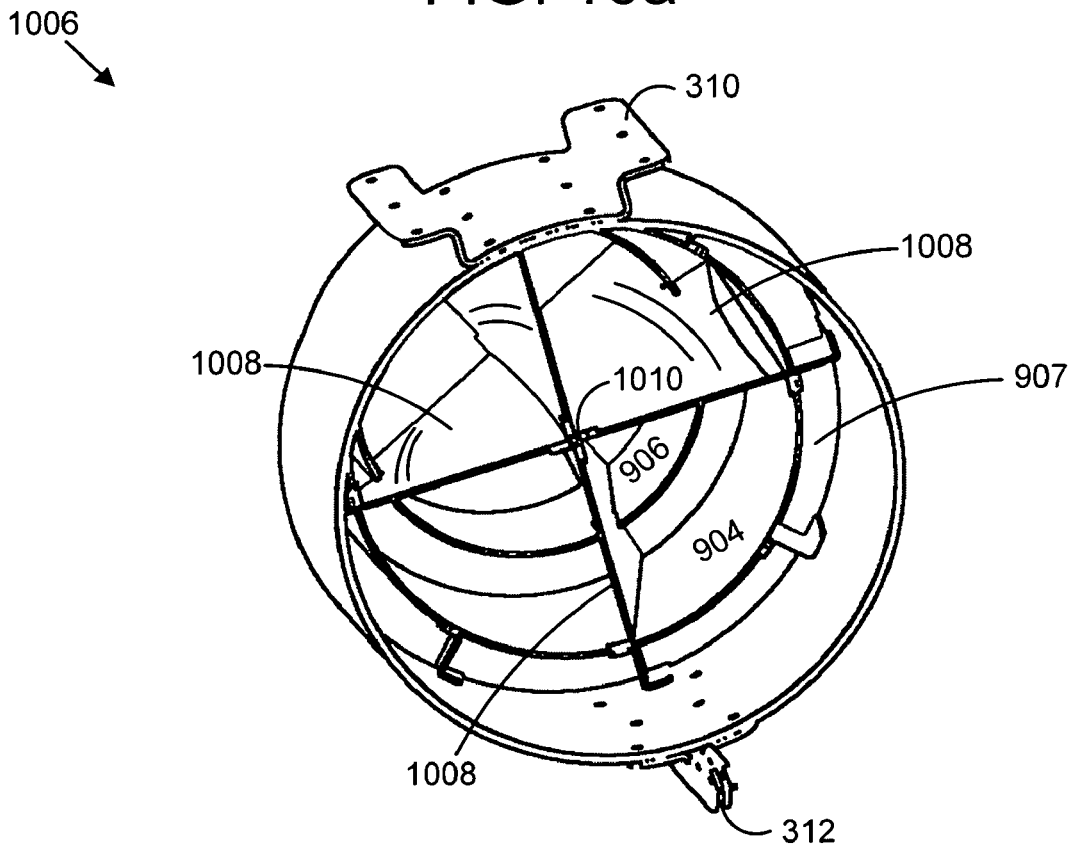
FIG. 10*b* is a perspective view of one embodiment of interior surfaces of a telescoping shroud in accordance with the present invention.

FIG. 10*b* is a perspective view taken from the front and top and illustrates one embodiment of interior surfaces 1006 of the telescoping shrouds 900, 908, 1000. The interior surfaces 1006 of the shroud may include a plurality of vanes 1008 extending inward and forming an intersection 1010, which is in the depicted embodiment a cross-like configuration. In one embodiment, the shroud may have four vanes 1008. Alternatively, the shroud may comprise any number of vanes 1008. The vanes 1008 may be angled to direct water to form a vortex as the water exits the shroud. In a further embodiment, the vanes 1008 may be replaced by the vanes 402. The vane 402 may be coupled to the first cylinder 902 and extend longitudinally towards the rear of the shroud 900, 908, 1000.

Figure 11:
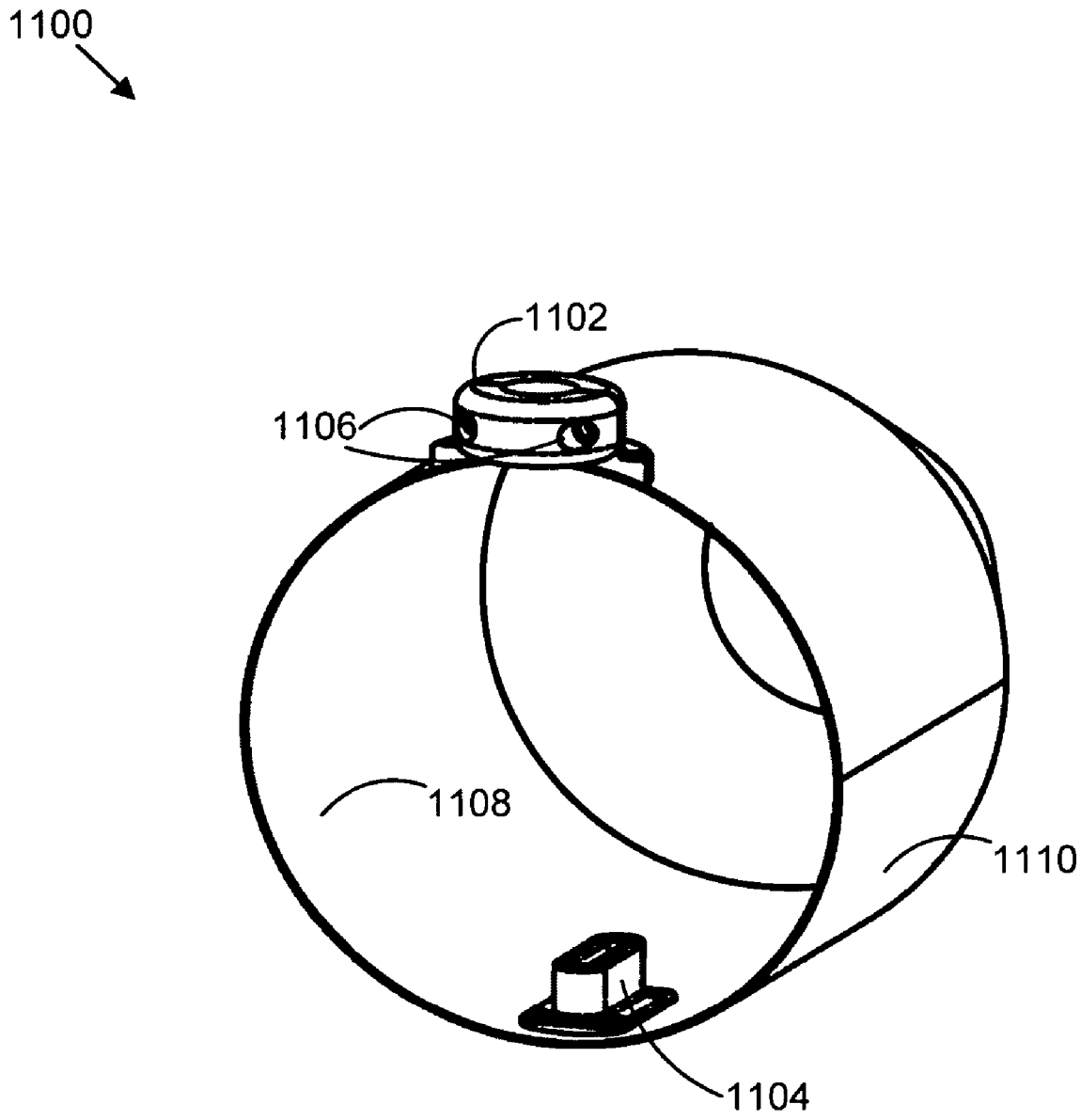
FIG. 11 is a perspective view of one embodiment of a shroud for trolling motors in accordance with the present invention.

FIG. 11 is a perspective view diagram illustrating one embodiment of a shroud 1100 suitable for use with trolling motors. In one embodiment, the shroud 1100 includes a mounting collar 1102 and a skeg collar 1104. The mounting collar 1102 may be a clamshell-like mounting device for receiving a drive shaft (not shown) of the trolling motor. Fasteners 1106 are configured to securely maintain the position of the shroud 1100 relative to the drive shaft. The skeg collar 1104 may be coupled to an inside surface 1108 of the shroud 1100, or alternatively to an outside surface 1110 of the shroud 1100. The skeg collar 1104 is configured to slidably receive a skeg (not shown) of the trolling motor. The shroud 1100 may implement the plurality of vanes 402 as described with reference to FIGS. 4-7 or alternatively the cross-like vanes 1008 configuration of FIG. 10*b*.

Figure 12:
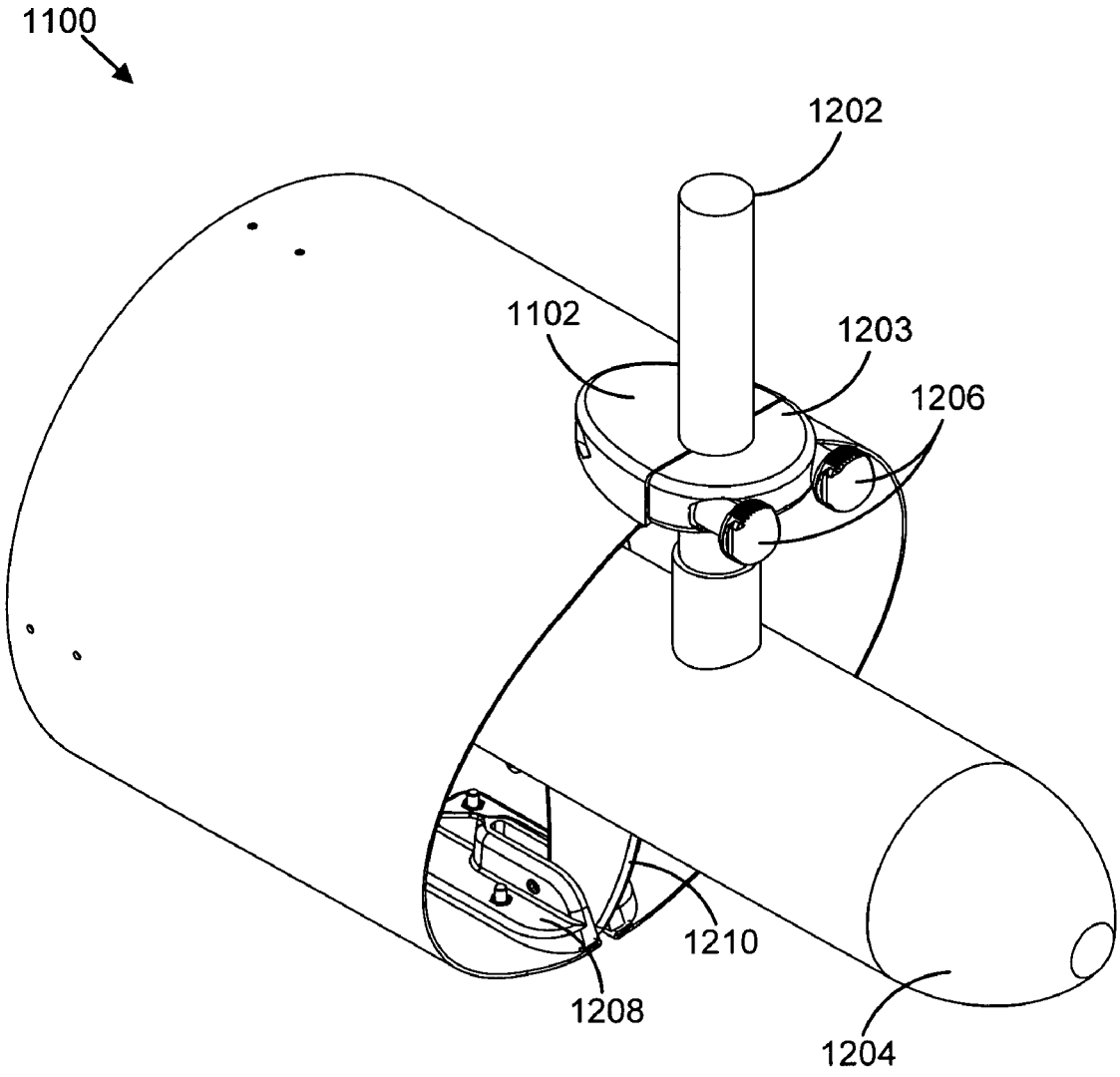
FIG. 12 is a perspective view of an alternative embodiment of a shroud for trolling motors in accordance with the present invention.

FIG. 12 is a perspective view diagram illustrating an alternative embodiment of the shroud 1100 suitable for use with trolling motors in accordance with the present invention. In one embodiment, the collar 1102 is configured to engage a down shaft 1202 of a trolling motor assembly. The collar 1102 may be configured with a removably coupled portion 1203 that may be removed during the installation process such that the removably coupled portion 1203 works in concert with the collar 1102 to surround the down shaft 1202. The trolling motor assembly generally includes the down shaft 1202 which couples a submersible motor housing 1204 with a motor control assembly (not shown) that allows a user to control the speed and direction of the trolling motor assembly.

A plurality of fasteners 1206 may secure the collar 1102 and subsequently the shroud 1100 to the down shaft 1202. The shroud 1100 may also include an adjustable skeg collar 1208. The position and shape of a skeg 1210 generally depends on the manufacturer of the trolling motor assembly. As such, the adjustable skeg collar 1208 may have an universal adapter for receiving the skeg 1210 of any trolling motor assembly. The skeg collar 1208 may slidably engage the skeg 1210, and be positionable on the interior surface of the shroud 1100. In one embodiment, the adjustable skeg collar 1208 is fastened to the shroud using a rivet, or the like.

Figure 13:
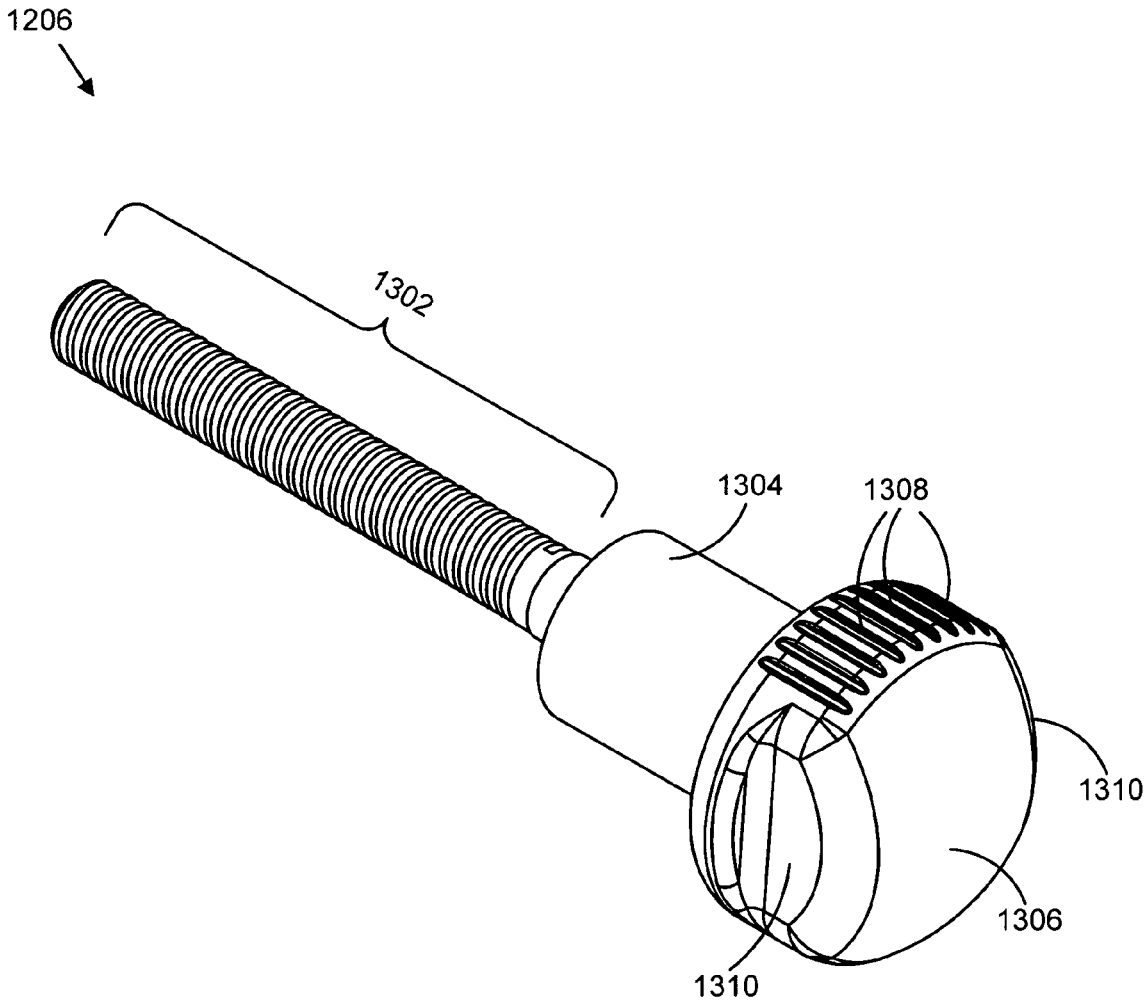
FIG. 13 is a perspective view of one embodiment of a fastener in accordance with the present invention.

FIG. 13 is a perspective view of a fastener 1206 in accordance with the present invention. In one embodiment, the fastener 1206 may comprise a thumbscrew as depicted. The fastener 1206 includes a threaded cylindrical portion 1302 for screwing into the collar 1102, a collar portion 1304 of the fastener 1206, and ahead 1306. As depicted, the head 1306 may be formed with integral grooves 1308 for providing friction between the fingers of the user and the head 1306. Additionally, the head 1306 may include cut-out portions 1310 for engaging the fingers of the user.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for directing fluid from a hydro-drive device, the apparatus comprising:

a shroud having a first opening for the ingress of water, and a second opening for the egress of water;

a vane extending inward from an interior surface of the shroud and angled in a direction selected to direct water into a vortex as the water exits the shroud; and a connector mechanism configured to connect the shroud to the hydro-drive device.

2. The apparatus of claim 1, wherein the vane comprises a planar region directly attached to an interior surface of the shroud and a curved region configured to change curvature in response to increasing or decreasing thrust from the hydro-drive device.

3. The apparatus of claim 1, wherein the vane is formed of a material having a tension configured to allow the curvature of the vane to change in response to an increased thrust of the hydro-drive device and to return to an original configuration upon a decreased thrust.

4. The apparatus of claim 1, further comprising a spring tension bar having a first end coupled to the interior surface and a second end removably coupled to a paddle.

5. The apparatus of claim 4, wherein the paddle is configured to adjust the diameter of the second opening in response to thrust from the hydro-drive device.

6. The apparatus of claim 5, wherein the vane is directly connected to a surface of the paddle.

7. The apparatus of claim 1, further comprising at least a second vane, the vane and the second vane extending toward each other and intersecting with each other.

8. The apparatus of claim 1, further comprising a plurality of vanes extending toward the interior of the shroud, each vane configured to direct water to form a vortex that exits the shroud.

9. The apparatus of claim 1, further comprising a mounting plate coupled to an outside surface of the shroud, the mounting plate configured to couple the shroud to a vehicle.

10. The apparatus of claim 1, wherein the shroud is configured to at least partially enclose the hydro-drive device.

11. The apparatus of claim 1, wherein the connector mechanism comprises a mounting plate coupled to an exterior surface of the shroud, the mounting plate configured to removably couple to a surface of a marine vehicle.

12. The apparatus of claim 1, wherein the connector mechanism comprises a skeg coupler connected to the exterior surface of the shroud, the skeg coupler configured to slidably couple to a skeg of the marine vehicle.

13. The apparatus of claim 12, further comprising a keyed fastening device for coupling the skeg coupler to the skeg, the unique fastening device configured to prevent theft of the shroud or the hydro-drive device.

14. The apparatus of claim 1, further comprising a collar coupled with an outside surface of the shroud and configured to securely engage a down shaft of a trolling motor, the collar formed of a removably coupled portion and a portion fixed with the shroud, the portions configured to surround the down shaft.

15. The apparatus of claim 1, further comprising a thumbscrew configured to couple the removably coupled portion to the fixed portion and securely engage the down shaft.

16. The apparatus of claim 1, wherein the vane is formed having a curvature throughout the length of the vane.

17. The apparatus of claim 1, wherein the vane is formed having a curvature at the distal end of the vane.

18. A system for directing fluid from a hydro-drive device, the system comprising:

a motor;

a hydro-drive device coupled to the motor;

a shroud having a first opening for the ingress of water, and a second opening for the egress of water;

a vane extending inward from an interior surface of the shroud and angled in a direction selected to direct water into a vortex as the water exits the shroud; and a connector mechanism configured to connect the shroud to the hydro-drive device.

19. The system of claim 18, wherein the vane is formed of a material having a tension configured to allow the curvature of the vane to change in response to an increased thrust of the hydro-drive device and to return to an original configuration upon a decreased thrust.

20. The system of claim 18, further comprising a spring tension bar having a first end coupled to the interior surface and a second end removably coupled to a paddle.

21. The system of claim 20, wherein the paddle is configured to adjust the diameter of the second opening in response to thrust from the hydro-drive device.

22. The system of claim 18, wherein the connector mechanism comprises a mounting plate coupled to an outside surface of the shroud, the mounting plate configured to couple the shroud to a marine vehicle.

* * * * *